United States Patent [19]

Dickson

[11] 4,138,620

[45] Feb. 6, 1979

[54] MULTI-PANEL ELECTROLUMINESCENT LIGHT ASSEMBLY

[75] Inventor: Arthur D. Dickson, St. Paul, Minn.

[73] Assignee: Minnesota Mining and Manufacturing Company, St. Paul, Minn.

[21] Appl. No.: 890,024

[22] Filed: Mar. 24, 1978

[51] Int. Cl.[2] ..... H05B 33/12; G09F 13/04; G09F 13/22

[52] U.S. Cl. ..... 313/1; 40/544; 313/498; 313/512; 362/84; 362/219; 362/225

[58] Field of Search ..... 313/49, 51, 1, 498, 313/511, 512; 362/84, 97, 147, 219, 226, 227, 225 (U.S. only); 40/544, 542 (U.S. only)

[56] References Cited

U.S. PATENT DOCUMENTS

| | | | |
|---|---|---|---|
| 3,068,376 | 12/1962 | Hammell et al. | 313/498 |
| 3,155,324 | 11/1964 | Chen | 313/512 X |
| 3,161,797 | 12/1964 | Butler et al. | 313/512 |
| 3,344,269 | 9/1967 | Brown | 362/84 |

*Primary Examiner*—Palmer C. Demeo
*Attorney, Agent, or Firm*—Cruzan Alexander; Donald M. Sell; William B. Barte

[57] ABSTRACT

A multi-panel electroluminescent panel assembly is provided in which an area extending over several panels may be uniformly illuminated by light produced by the panels, and over which non-illuminated areas, stripes or the like resulting from electrode contacts are eliminated. Each panel is constructed such that the light produced per unit area is substantially uniform throughout the panel, including that from an area immediately adjacent at least one edge thereof. The panels are assembled in an overlapping arrangement such that non-illuminating areas of one panel are covered by illuminating areas of at least one other panel. The assembly of panels provides a large area source of uniform illumination suitable for back-lighting graphic indicia, and may be desirably included as signboards on the sides of motor vehicles such as transport trucks, buses, etc.

4 Claims, 5 Drawing Figures

MULTI-PANEL ELECTROLUMINESCENT LIGHT ASSEMBLY

BACKGROUND OF THE INVENTION (1) Field of the Invention

This invention relates to electroluminescent devices and to large area display panels such as employ uniformly illuminated surfaces to back-light graphic matter positioned thereover.

(2) Description of the Prior Art

Electroluminescent devices are generally well known, particularly as small area devices suitable for use as bedroom night-lights and the like. The development of larger area devices of several square feet or more has, for the most part, been thwarted by two factors: the devices utilize a transparent electrode which must also be sufficiently conductive so that unipotential surfaces exist when a voltage is applied to one edge of the electrode, thus enabling uniform emission-/unit area throughout the device. Since such electrodes are often metallic thin-films, the conductivity of the electrode is optimized simply by making the film thicker; however, with thickness comes opacity; for a transparent electrode, the film must be as thin as possible.

Accordingly, prior art devices are generally constructed with an appropriately transparent electrode in which the conductivity is so low that an unacceptable potential drop exists across the surface if the device extends beyond a few inches from a bus bar. Such devices are, therefore, generally not larger than a few inches in diameter. While larger area devices have been proposed that utilize such bus bars extending in a grid-like fashion across the face of the device, such devices have not been well accepted, as the bus bars obscure light generated therebelow, resulting in the non-uniform emission of light.

Recently, techniques have been developed in which the transmissivity of such transparent electrodes has been improved through the use of a multiple-layer electrode in which a metal electrode of Au, Ag or Cu is sandwiched between thin-film layers of a dielectric material, thus forming antireflecting quarter-wavelength interference filters. An electroluminescent panel utilizing such a construction is disclosed and claimed in U.S. Pat. No. 4,020,389 (Dickson and Pruitt). Additional techniques have also been developed for effectively contacting the electrodes of such constructions. U.S. Pat. No. 4,066,925 (Dickson). While such constructions have enabled the exploitation of electroluminescent panels several feet long on each side, there yet exists a desire for electroluminescent panels useful in backlighting billboards and other larger area panels.

SUMMARY OF THE INVENTION

The present invention is directed to a multi-panel electroluminescent light assembly using a plurality of devices similar to those discussed above in a manner that a much larger display is provided, over which the emissions per unit area is substantially constant, and over which there are no light-interrupting, light-obscuring electrodes. The assembly comprises a substantially planar support member having an array of at least two electrical conductors electrically insulated from each other and extending in spaced and substantial co-planar relationship across the support member. A plurality of substantially identical electroluminescent panels are mounted onto the support member adjacent each other in an overlapping arrangement, and each panel is constructed so as to emit light uniformly to the edge of at least one side thereof. Accordingly, any non-light emitting areas along some edges of some of the panels are covered by portions of other panels terminating with an edge along which the emission is substantially the same as that over the major portion of the panel.

Each of the panels include the following members: a laminate of an electroluminescent layer sandwiched between two sheet-like electrode layers, one of which is substantially transparent, at least two metal mesh strips, each of which is electrically connected to one of the electrode layers and extends away therefrom to enable external electrical connections to the panel, and a transparent, weather-resistant, moisture impermeable envelope through which the metal mesh strips extend.

The layers of the laminate terminate along at least one common edge, thereby enabling the substantially uniform emission of light per unit area throughout the electroluminescent layer, including that area thereof which is immediately adjacent the common edge. Similarly, the envelope is provided to form a seal around the metal mesh strips, while not obstructing light emitted from the laminate, including that produced by the area immediately adjacent the common edge.

By such an overlapped construction, the assembly provides a substantially uniformly illuminated area which extends over all of the panels, throughout which nonilluminated bands corresponding to electrode connections, bus bars or the like are eliminated. Such a large uniformly illuminated area is particularly suitable for back-lighting graphic transparencies placed thereover.

The present invention is particularly advantageously utilized as a portion of a mobile billboard, such as may be included on the sides of semi-trailer trucks and the like. The low power consumption of electroluminescent panels make them particularly desirable for such applications. In a particularly desirable embodiment, for example, such an assembly may consist of three electroluminescent panels, each of which is approximately one foot (30 cm) wide and 4.5 feet (140 cm) long. When the panels are thus assembled according to the present invention, a total illuminated area approximately 30 inches × 52 inches is realized. During use, individual panels may become less efficient or even inoperative in localized areas such as by damage to the envelope, which allows moisture to seep into the laminate and thereby degrade the performance, or by physical damage such as rocks or the like hitting the panel, causing the electrodes to short out. In such an event, the assembly of the present invention enables a defective panel to be removed, a new panel inserted and connected in its place, thus providing a considerable economy over that present should the entire assembly have to be replaced.

DESCRIPTION OF THE PREFERRED EMBODIMENTS

Figure 1:
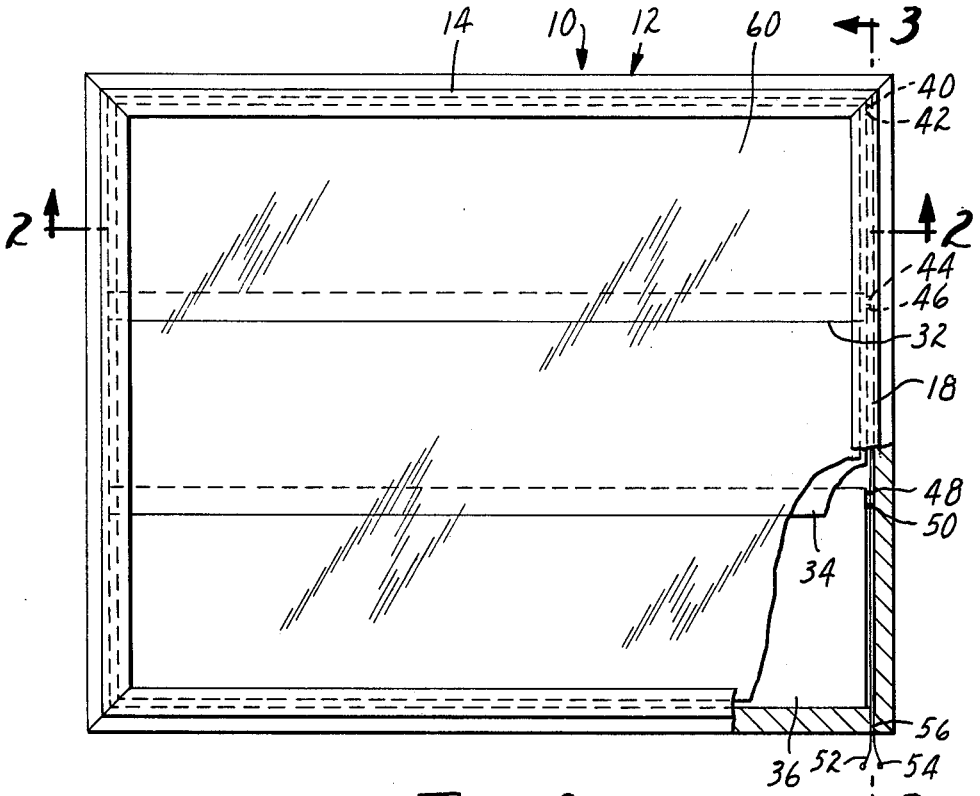
FIG. 1 is an overall view of the multi-panel assembly of the present invention.

A preferred multi-panel electroluminescent light assembly according to the present invention is shown in the overall frontal view of FIG. 1. The assembly 10 is there shown to comprise a housing 12 which includes a frame 14 secured to a backing plate 16. One side 18 of the frame is removeable to allow the frame to be opened and additional members inserted therein. Preferably, the backing plate 16 consists of an aluminum sheet onto which are riveted extruded aluminum members forming the frame 14. The housing 12 is also shown in cross section along the lines 2—2 in FIG. 2 to more clearly depict the respective components.

The assembly further includes three electroluminescent panels 32, 34 and 36, mounted on a support member 38 in an overlapping configuration such that the upper portion of panel 36 is obscured by the lower portion of the panel 34 and the upper portion of panel 34 is in turn obscured by the lower portion of panel 32. Since, as will be described in more detail hereinafter, each of the panels is constructed so as to uniformly emit light over most of the panel surface, and to so emit to at least one edge of the surface, that edge being the exposed, or lower portion of each of the respective panels, such an overlapping configuration results in the production of a uniformly illuminated area extending over all of the panels. Non-light producing areas on each panel such as that resulting from electrodes extending across the top of each of the panels are thus hidden. The support member 38 is preferably a relatively stiff, yet flexible sheet, such as a 30 mil (0.76 mm) sheet of polypropylene. The panels are desirably adhered thereto by a transfer adhesive, doublecoated adhesive tape or the like, such that a given panel may be easily removed and replaced.

The thus obscured electrodes of each of the panels are in turn connected to a pair of electrode connecting strips 40 and 42, 44 and 46, and 48 and 50, respectively, which strips extend from one side of each respective panel into a recess 23 below the side 18 of the frame. The contact strips are in turn connected in parallel to a pair of wires 52 and 54, coupled through an opening 56 in the housing 12, enabling the wires to be connected to an external power source.

Figure 2:
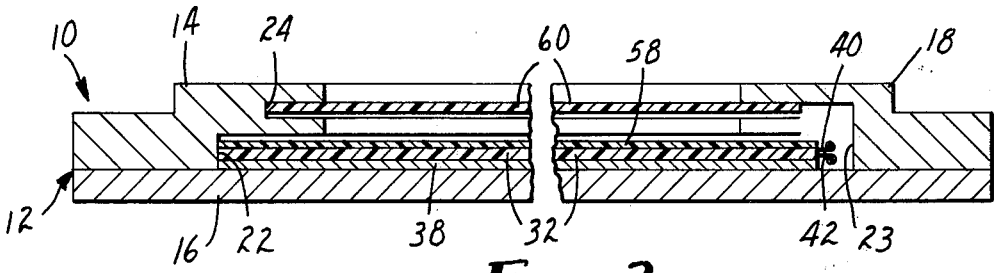
FIG. 2 is a cross sectional top view of the assembly of FIG. 1 taken along line 2—2.

As shown in more detail in FIG. 2, within the recess 22 are positioned the support member 38, the assembly of panels, a single one of which 32 is there shown, and a sheet of graphic matter 58 overlying the electroluminescent panels. Also, within the recess 24 is preferably positioned a transparent protective sheet 60 such as a 30 mil thick acrylic polymeric film.

Figure 3:
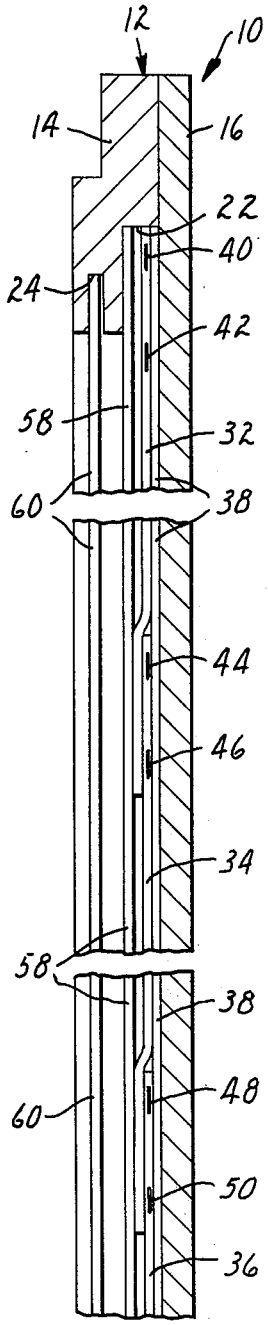
FIG. 3 is a partial cross sectional side view of the assembly of FIG. 1 taken along line 3—3.

The manner in which the three panels 32, 34 and 36, respectively, are overlaid upon each other is further shown in FIG. 3, which is a cross section taken across the line 3—3 of the assembly shown in FIG. 1. Thus, in FIG. 3, the frame 14 and backing plate 16 are clearly set forth, as is the protective sheet 60 held in place within the recess 24. The members held within the recess 22 are more readily shown to include the support member 38, the electroluminescent panels 32, 34 and 36, respectively, as well as the sheet 58 containing graphic matter. In this figure, the contacts 40 and 42 of panel 32, 44 and 46 of panel 34, and 48 and 50 of panel 36 are also more readily indicated.

Figure 4:
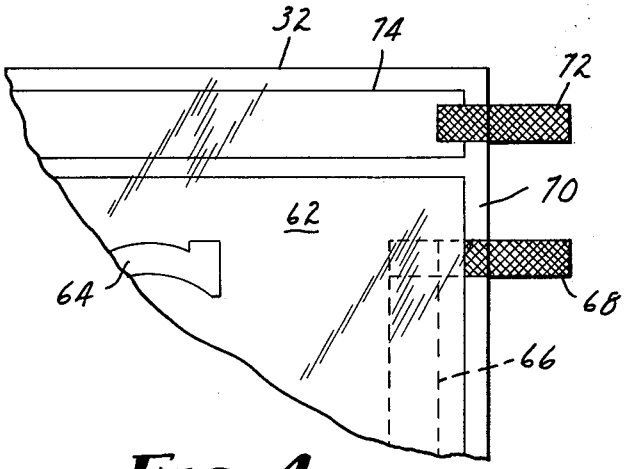
FIG. 4 is a partial front view of a panel included in the assembly of FIG. 1.

The manner in which the conducting strips associated with each electroluminescent panel extend into the recess below the hinged portion 18 of the frame is further shown in FIG. 4. In this figure, the top electroluminescent panel 32 may be seen to include a sheet of electroluminescent material 62 having thereover a sheet of graphic matter containing printed indicia 64. The electroluminescent layer 62 has on the back side thereof a metal foil such as aluminum, to which is secured a metal tape 66 which provides an ohmic contact to the foil. The tape 66 is in turn soldered to a metal mesh contact strip 68, which contact strip extends through a transparent envelope 70, within which is hermetically sealed the entire panel 32. A second metal mesh contact strip 72 also extends through the envelope 70 and is soldered to a second metallic tape 74 which extends along the top of the panel 32 and provides an ohmic contact to a transparent, conductive electrode extending across the face of the phosphor layer 62. The metal mesh contact strips 68 and 72 are desirably provided in that they greatly facilitate the connection thereto of conventional electrical leads such as the wires 52 and 54 shown in FIG. 1, while also providing a sealed conductive path through the envelope 70. The envelope 70 is preferably formed of two sheets of a heat sealable polymeric material. When the edges of the sheets are heated and pressed together, each sheet slightly flows into the interstices of the mesh such that the mesh is sealed between the bonded sheets.

Figure 5:
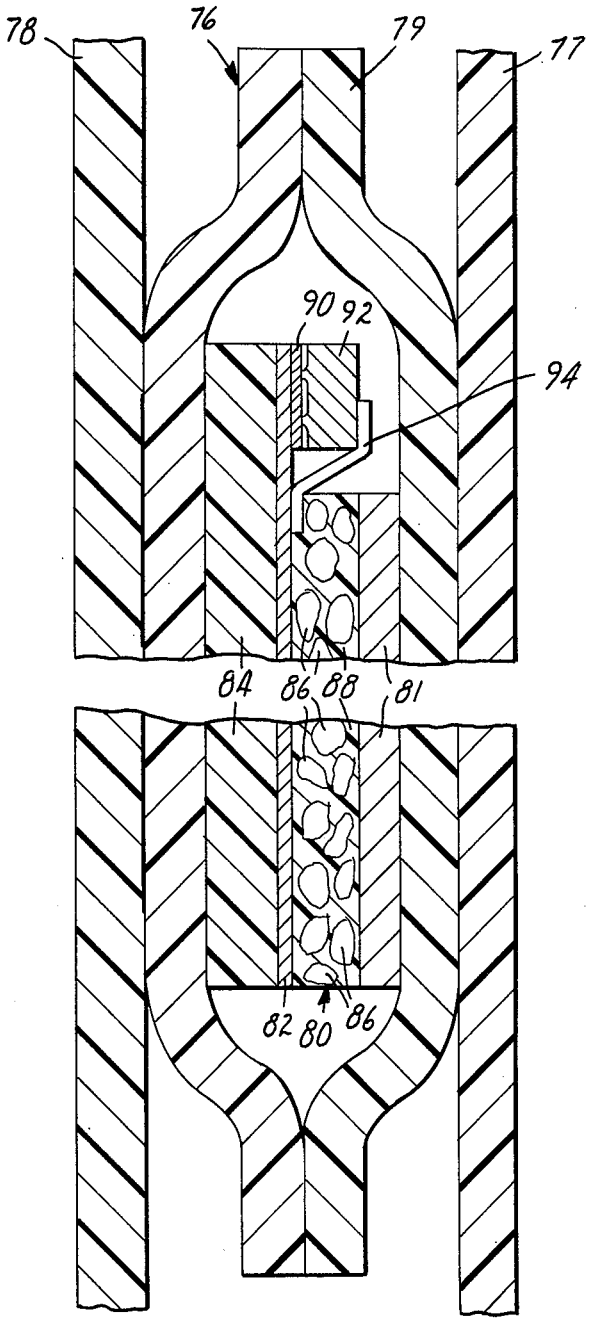
FIG. 5 is a cross sectional view of a single panel included in the assembly of FIG. 1.

FIG. 5 shows a detailed cross sectional view of a preferred electroluminescent panel 76 such as would be sandwiched between a support member 77 and a graphic overlay 78. Such an assemblage would be held within a recess like that shown in FIGS. 2 and 3. The panel 76 is shown in FIG. 5 to include an electroluminescent device such as that disclosed and claimed in U.S. Pat. No. 4,066,925, the disclosure of which is incorporated herein by reference. The envelope 79 is preferably formed of sheets of polychlorofluoroethylene such as "Aclar" Brand film manufactured by the Allied Chemical Company, General Chemical Division. Such films may be one of a series of fluorohalocarbon films and are particularly desired in that they are both transparent, provide exceptional vapor barriers and may be heat-sealed to provide a hermetic seal. Other heat-sealable, substantially moisture-impermeable polymeric films may similarly be employed. Alternatively, sealing in a moisture impermeable envelope may be disposed with if one employs phosphors encapsulated in a moisture barrier film of $TiO_2$ or equivalent. Such encapsulated phosphors are, for example, described in AD Report No. 840,747 (1968).

The electroluminescent lamp sealed within the envelope 79 comprises a sandwich of a layer of electroluminescent material 80 between an aluminum foil electrode 81 and a transparent electrode 82. The transparent electrode 82 is preferably carried on a transparent support member 84. As set forth in the above-referenced patent, the layer of electroluminescent material 80 is preferably prepared as a preform, in which a layer of electroluminescent particles 86 within a flexible organic binder 88 is coated onto the sheet of aluminum foil 80. The particles 86 desirably have an average particle size of approximately 30 micrometers and are coated out in solution to provide a dried coating thickness of approximately 75 micrometers. Similarly, the transparent electrode 82 is likewise initially provided as a preform of thin-film coatings on the support member 84.

A particularly preferred electrode construction is that which is disclosed and claimed in my previously issued patent, U.S. Pat. No. 4,020,389, which is also incorporated herein by reference. In such an electrode construction, a transparent thin-film metal layer is sandwiched between thin dielectric layers having a relatively high index of refraction. The dielectric layers provide quarter-wavelength interference filters, and result in a high degree of transmittance of the electrode while enabling the metal layer to be sufficiently thick to result in a low resistivity electrode. The transparent electrode shown in the panel of FIG. 5 further includes a thicker metal thin-film 90 which is evaporated along one edge of the panel and serves to further distribute potential supplied to the panel throughout the transparent thin-film metal layer. An electrical potential is coupled to the metal film 90 via a metal pressure sensitive adhesive tape 92 to which may be soldered a metal mesh contact strip such as discussed hereinabove. A strip of electrical insulating tape 94 may be included to minimize electrical shorts between the A1 foil electrode 81 and the metal tape 92. Such electroluminescent panels are particularly preferred, in that the exceptional transmittance and conductive characteristics of the electrodes enable the construction of a particularly exemplary electroluminescent panel which may extend at least one foot along one dimension and many feet along the other direction, while yet enabling a relatively uniform potential to be established throughout the panel at reasonable operating voltages, thus providing uniform light emission throughout the panel. Other panel constructions in which the transparent electrode comprises metal coated glass strands or other known electrode constructions may likewise be utilized.

Thus, for example, the panel shown in FIG. 5 preferably includes a 65–75 micrometer layer of aluminum foil, which in turn is pressed against a transparent electrode preform comprising three evaporated thin-films, the total thickness of which is approximately 0.1 micrometers coated on a 100 micrometer thick layer of a transparent polymer, such as polyester. The total thickness of such a construction is approximately 220 micrometers, and when sealed within an envelope having 125 μm thick walls provides a panel having a total cross sectional thickness of less than 500 micrometers.

An assembly of three panels, each approximately one foot wide and five feet long (30 cm × 150 cm) with an overlap between adjoinging panels of approximately two inches (5 cm) so as to provide a total uniformly illuminated area of approximately 30 inches by 60 inches (75 cm × 150 cm). When such panels are electrically connected in parallel, they are desirably energized by a 400 hertz power supply, providing approximately 190 volt RMS at a power level of approximately 7 watts per square foot. Such a power supply may be energized by either 110 volt AC or even low voltage DC power sources such as are typically provided in semi-trailer trucks, buses and the like. The panels may thus be utilized on the sides of such vehicles, thereby enabling advertising messages, vehicle identification and the like to be back-illuminated.

In a particularly desirable embodiment in which the panels are utilized on the sides of motor vehicles, the graphic indicia to be placed thereover is further designed such that printing inks and the like utilized therein may be opaque so as to obscure the electroluminescent light produced by the panels therebelow, and may also be tailored to include fluorescent pigments such that a variety of colors of graphic indicia may be provided. Such pigments may thus be selected to absorb the narrow wavelength of light produced by the electroluminescent panels and to convert the absorbed radiation into light of other colors. Desirably, such fluorescent pigments are combined with printing inks to provide multicolored graphic messages which appear to be much the same color whether viewed in daylight with reflected light or when viewed at night when back-illuminated with light from the electroluminescent panels.

While in the embodiment described above, one foot wide (30 cm) electroluminescent panel constructions were desirably employed, the panels may similarly be provided in greater or lesser widths. However, the one foot (30 cm) width is particularly useful in that a minimum number of panels may be provided while yet allowing individual panels to be readily replaced, should one of the panels become defective. The one foot wide panel width has the further desirable feature of minimizing waste product produced in the event the coating procedure is defective.

Panel assemblies are also desirably restricted to a size not much larger than about 15 $ft^2$ (1.4 $m^2$). Assemblies of such size enable the use of efficient power supplies including a resonant circuit in which the capacitance of the electroluminescent panels is matched with an inductive component to establish the resonant frequency. Such resonant circuits greatly simplify the design of power supplies where operation at frequencies, such as 400 Hz, is desired. If the panel assemblies exceed such a size, the capacitance of the panels dictates the use of an inductive component having an excessively low inductance. In an extreme case, the desired inductance could be less than that associated with the connecting leads alone. Since the inductive component is desirably provided as the secondary winding of a transformer within the power supply, a requirement that the inductance of the winding be extremely low precludes efficient transformer design. Accordingly, larger panel assemblies are desirably grouped in sections, each section being driven by a separate power supply.

Having thus described the present invention, what is claimed is:

1. A multi-panel electroluminescent light assembly comprising (a) a substantially planar support member, (b) an array of at least two electrical conductors electrically insulated from each other and extending in spaced and substantially co-planar relationship across said support member, (c) a plurality of substantially identical electroluminescent panels, each of which include the following members:

(i) a laminate of electroluminescent layer sandwiched between two sheet-like electrode layers, at least one of which is substantially transparent wherein the layers of the laminate terminate along at least one common edge enabling the substantially uniform emission of light per unit area throughout said electroluminescent layer, including that area thereof which is immediately adjacent said common edge and away therefrom, (ii) at least two metal mesh strips electrically connected to each of the electrode layers and extending co-planar therewith and away therefrom, and (iii) a transparent, weather-resistant, substantially moisture impermeable envelope through which said metal mesh strips extend along one edge and which does not obstruct light emitted from said laminate, including that produced by the area immediately adjacent said common edge, wherein said plurality of panels are mounted onto said support member adjacent each other in an overlapping arrangement and said metal mesh strips connected to said electrical conductors enabling all the panels to be energized from a single external power source, such that non-light emitting areas along some edges of some panels are covered by portions of other panels terminating with said common edge over which substantially uniform emission is produced, thereby providing a substantially uniformly illuminated area extending over all of the panels throughout which non-illuminated bands corresponding to electrode connections or the like within each panel are eliminated, thus providing a panel suitable for uniformly back-lighting graphic transparencies placed thereover.

2. An assembly according to claim 1, wherein each of said electroluminescent panels comprises a said laminate including a layer of electroluminescent particles embedded within a light transmitting flexible resin body, sandwiched between a metal foil electrode and a substantially transparent, electrically conducting thin-film electrode, and wherein contact strips are located at common positions along a given edge of each panel to facilitate the connection of said strips to said conductor array.

3. An assembly according to claim 1, including a continuous electrically conductive metallic film in intimate conductive contact with said thin-film electrode and extending the length of the panel along one edge thereof, a metal foil tape adhesively secured to and extending a substantial length along said edge in electrically conducting relationship with the conductive metallic film, and a conductive metal mesh connecting strip conductively secured to said metal foil tape.

4. An assembly according to claim 1, wherein said conductor array extends in two directions to enable panels to be positioned on said support member in an overlapping configuration in two directions, such that non-light emitting areas along all interior edges of all panels are covered by light emitting areas of adjacent panels and such that damaged or otherwise improper panels may be selectively removed and replaced.

* * * * *